US010451092B2

(12) United States Patent
Shim et al.

(10) Patent No.: US 10,451,092 B2
(45) Date of Patent: Oct. 22, 2019

(54) SYSTEM FOR CONTROLLING COMPRESSOR

(71) Applicant: KYUNGWON MACHINERY CO., LTD., Siheung-si, Gyeonggi-do (KR)

(72) Inventors: Kyu Mun Shim, Siheung-si (KR); In Hyun Choi, Incheon (KR)

(73) Assignee: KYUNGWON MACHINERY CO., LTD., Siheung-si (KR)

( * ) Notice: Subject to any disclaimer, the term of this patent is extended or adjusted under 35 U.S.C. 154(b) by 99 days.

(21) Appl. No.: 15/904,107

(22) Filed: Feb. 23, 2018

(65) Prior Publication Data

US 2019/0264713 A1 Aug. 29, 2019

(51) Int. Cl.

| | |
|---|---|
| ***F04B 49/03*** | (2006.01) |
| ***F15B 15/14*** | (2006.01) |
| ***F15B 15/28*** | (2006.01) |
| ***F25B 49/02*** | (2006.01) |
| *F15B 11/032* | (2006.01) |

(52) U.S. Cl.

CPC ..... *F15B 15/1409* (2013.01); *F04B 49/03* (2013.01); *F15B 15/2815* (2013.01); *F25B 49/022* (2013.01); *F04B 2201/06* (2013.01); *F15B 11/032* (2013.01); *F15B 15/1457* (2013.01)

(58) Field of Classification Search

CPC ..... F15B 15/1409; F04B 49/03; F04B 49/06; F04B 35/04; F04B 49/22; F04B 53/001; F04B 53/10

See application file for complete search history.

(56) References Cited

U.S. PATENT DOCUMENTS 6,343,537 B1 2/2002 Iida et al.
2015/0308442 A1* 10/2015 Giove ..... F04D 27/0215 415/1

FOREIGN PATENT DOCUMENTS

| | | | |
|---|---|---|---|
| JP | 2001146907 | | 5/2001 |
| KR | 20090018436 | A * | 2/2009 |
| KR | 10-1452726 | | 10/2014 |
| KR | 101452726 | B1 * | 10/2014 |

* cited by examiner

*Primary Examiner* — Thomas E Lazo
(74) *Attorney, Agent, or Firm* — Fenwick & West LLP

(57) ABSTRACT

The present disclosure relates to a compressor control system that detects the pressure (or flow rate) at the rear end of a compressor and performs proportional control in mechanical manner to uniformly control the pressure (or flow rate) of the compressor while preventing a compressor suction valve from being fully closed. To this end, the present disclosure includes a cylinder including a first piston and a second piston therein, a pressure control valve which supplies fluid to operate the second piston to an area above the second piston, a control valve which supplies fluid to operate the first piston to an area above the first piston, and supplies fluid to the pressure control valve, a fluid condition transmission unit which detects fluid condition (pressure or flow rate) at a rear end of a compressor, and converts the detected fluid condition value to an electrical signal and outputs it.

7 Claims, 11 Drawing Sheets

SYSTEM FOR CONTROLLING COMPRESSOR

BACKGROUND

1. Field

The present disclosure relates to a compressor control system, and more particularly, to a compressor control system that detects the pressure (or flow rate) at the rear end of a compressor and performs proportional control in mechanical manner to uniformly control the pressure (or flow rate) of the compressor while preventing a compressor suction valve from being fully closed.

2. Description of the Related Art

A compressor is a mechanical device that receives power from a driving device such as an electric motor, an internal combustion engine or a turbine and compresses oil or air to increase the pressure, and to prevent accidents caused by high pressure air, means to control the pressure in a tank which stores high pressure air is required.

Conventional methods for controlling the pressure in the tank of the compressor include a load-unload driving method, an inverter control method, and a mechanical proportional control method.

FIG. 1 is a diagram illustrating a load-unload driving method and FIG. 2 is an exemplary diagram showing a pressure diagram and a power consumption diagram according to a load-unload driving method, and the load-unload driving method is a driving method that begins with load driving, and when the pressure in the tank of the compressor reaches the set working pressure, unloads the compressor, and when the air pressure drops to the differential pressure setting range, loads the compressor again to compress air.

The load-unload driving method has problems with the shortened life of bearing, rotors, gears and suction adjust valves of the compressor and a high energy loss due to control performed frequently when a load ratio is low. Additionally, to uniformly supply the pressure, it is necessary to install a separate complex flow rate adjustment device.

Meanwhile, the inverter control method is used with an expectation of energy saving effects when a load ratio is low (40-80%), but when considering the efficiency of the inverter itself and investment costs, energy saving effects are not obtained at the load ratio of 90% or more. Additionally, the inverter control method requires high costs in maintenance and repair. That is, when the inverter is out of order, energy costs saved from the maintenance and repair costs are used up.

FIG. 3 is a diagram illustrating conventional mechanical proportional control method, FIG. 4 is an exemplary diagram showing a pressure diagram according to conventional mechanical proportional control method, and FIG. 5 is an exemplary diagram showing a power consumption diagram of conventional mechanical proportional control method, showing a power consumption loss amount of mechanical proportional control compared to load-unload driving and a power consumption reduction amount of rated control compared to load-unload driving.

The mechanical proportional control method proportionally controls a mechanical proportional control valve in mechanical manner based on a pressure spring or diaphragm type pressure difference, and its initial investment cost is low, but accurate pressure control is impossible due to a slow response speed as shown in FIG. 4.

Additionally, when a compressed air load ratio is low, noise and vibration may occur due to excessive suction pressure control, and an excessive energy loss occurs at the compressed air load ratio of 85% or less as shown in FIG. 5.

SUMMARY

The present disclosure is designed to solve the above-described problem, and therefore the present disclosure is directed to providing a compressor control system that detects the pressure (or flow rate) at the rear end of a compressor and performs proportional control in mechanical manner to uniformly control the pressure (or flow rate) of the compressor while preventing a compressor suction valve from being fully closed, thereby reducing noise and vibration caused by excessive suction pressure control.

To achieve the above-described object, a compressor control system according to an embodiment of the present disclosure includes a cylinder including a first piston and a second piston therein, a pressure control valve which supplies fluid to operate the second piston to an area above the second piston, a control valve which supplies fluid to operate the first piston to an area above the first piston, and supplies fluid to the pressure control valve, a fluid condition transmission unit which detects fluid condition (pressure or flow rate) at a rear end of a compressor, and converts the detected fluid condition value to an electrical signal and outputs it, and a control unit which controls closing/opening of the control valve based on the fluid condition value received from the fluid condition transmission unit.

According to the compressor control system of the present disclosure, the pressure of the compressor may be controlled using a plurality of pistons, so that the pressure (or flow rate) of the compressor may be not only accurately controlled but also uniformly maintained while preventing the compressor suction valve from being fully closed, thereby reducing noise and vibration caused by excessive suction pressure control and achieving energy savings.

DETAILED DESCRIPTION

Hereinafter, a compressor control system according to an exemplary embodiment of the present disclosure will be described in detail with reference to the accompanying drawings.

Figure 1:
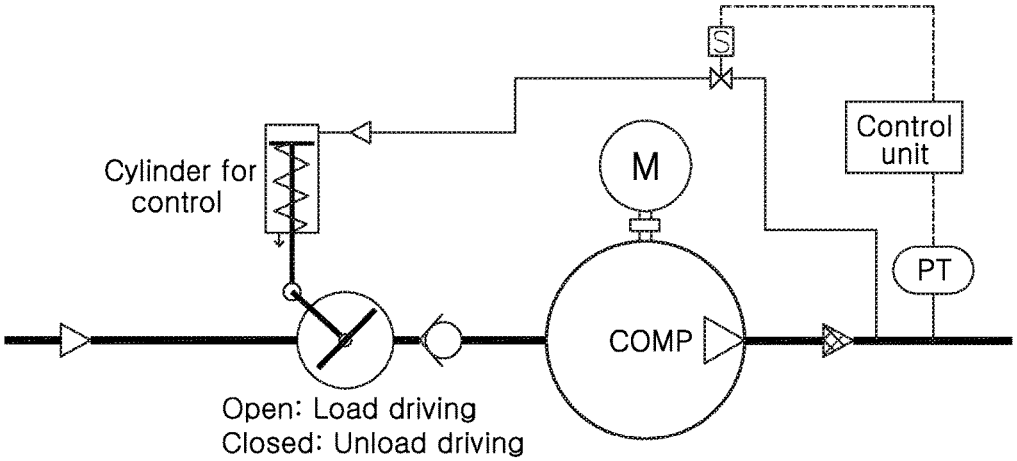
FIG. 1 is a diagram illustrating a load-unload driving method.
Figure 2:
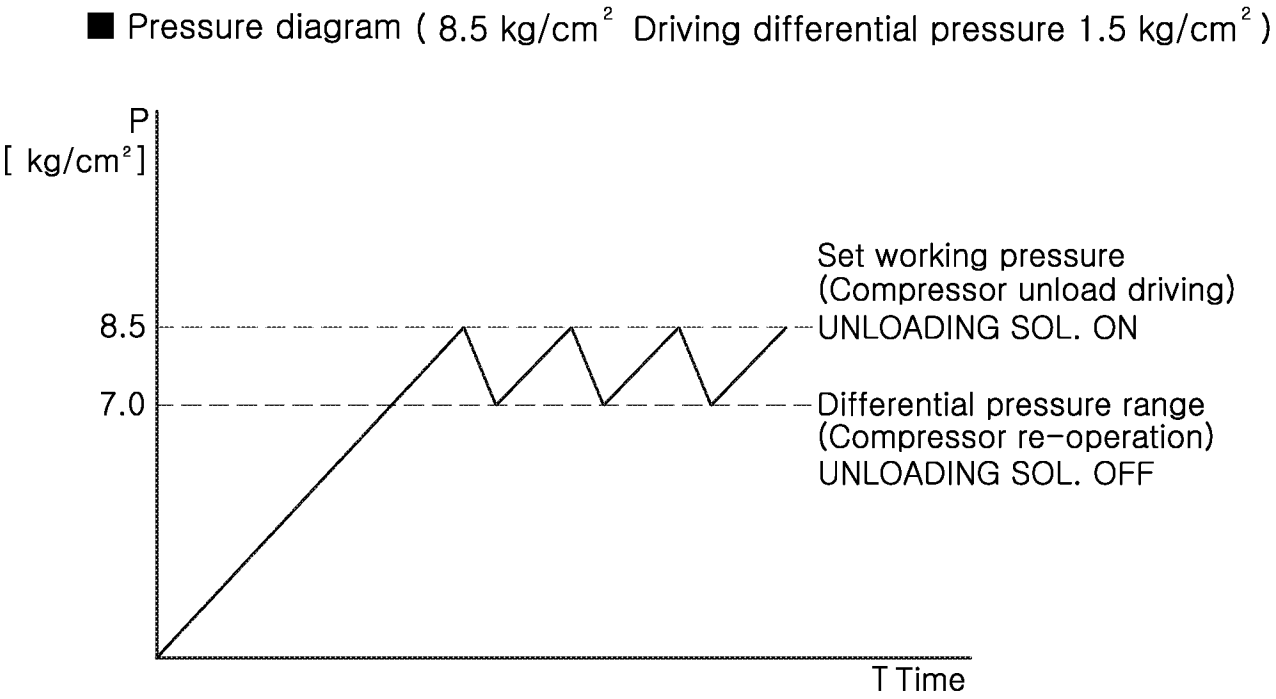
FIG. 2 is an exemplary diagram showing a pressure diagram according to a load-unload driving method.
Figure 3:
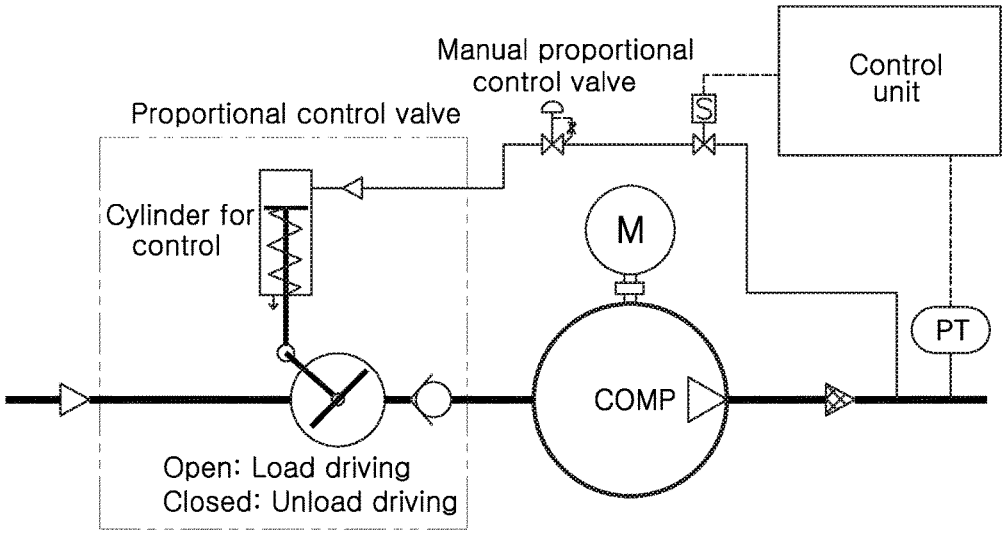
FIG. 3 is a diagram illustrating conventional mechanical proportional control method.
Figure 4:
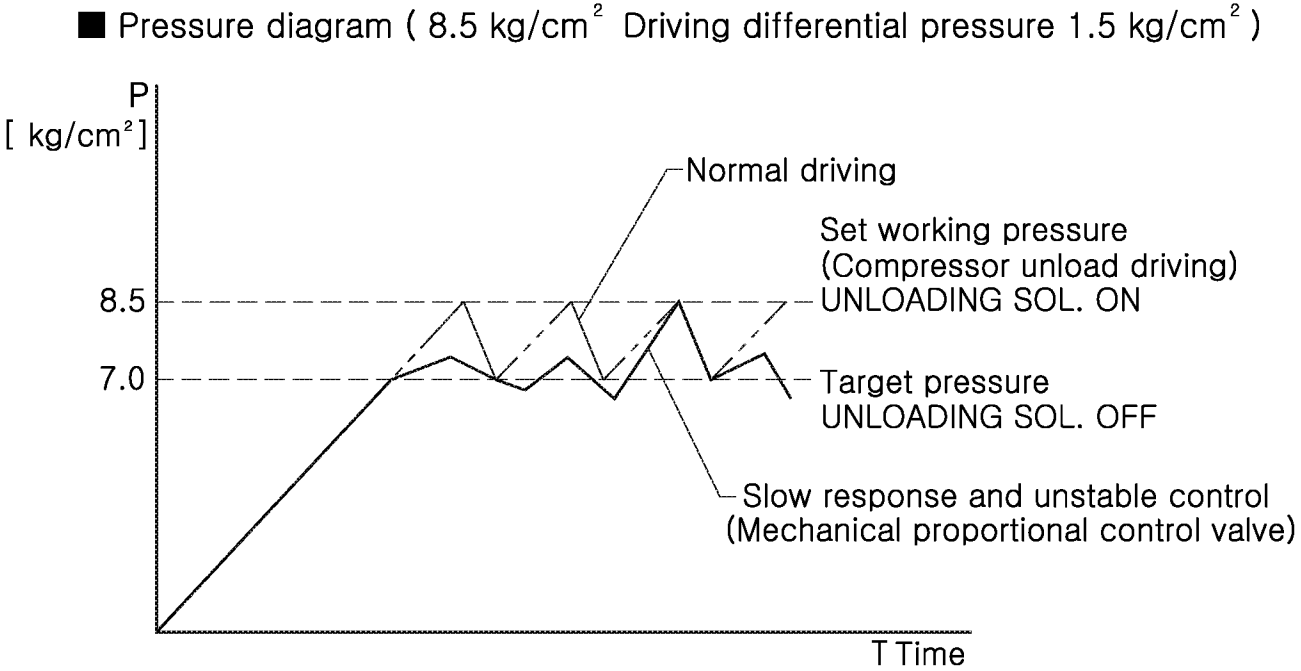
FIG. 4 is an exemplary diagram showing a pressure diagram according to conventional mechanical proportional control method.
Figure 5:
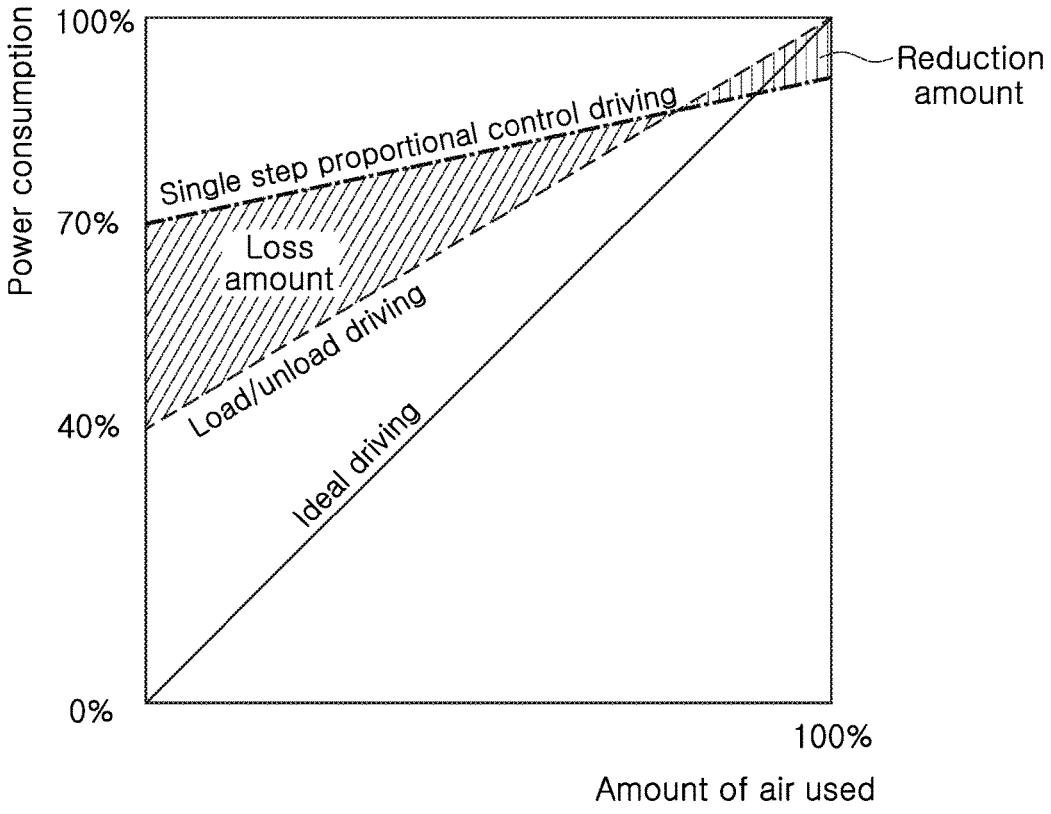
FIG. 5 is an exemplary diagram showing a power consumption diagram of conventional mechanical proportional control method, showing a power consumption loss amount of mechanical proportional control compared to load-unload driving and a power consumption reduction amount of rated control compared to load-unload driving.
Figure 6:
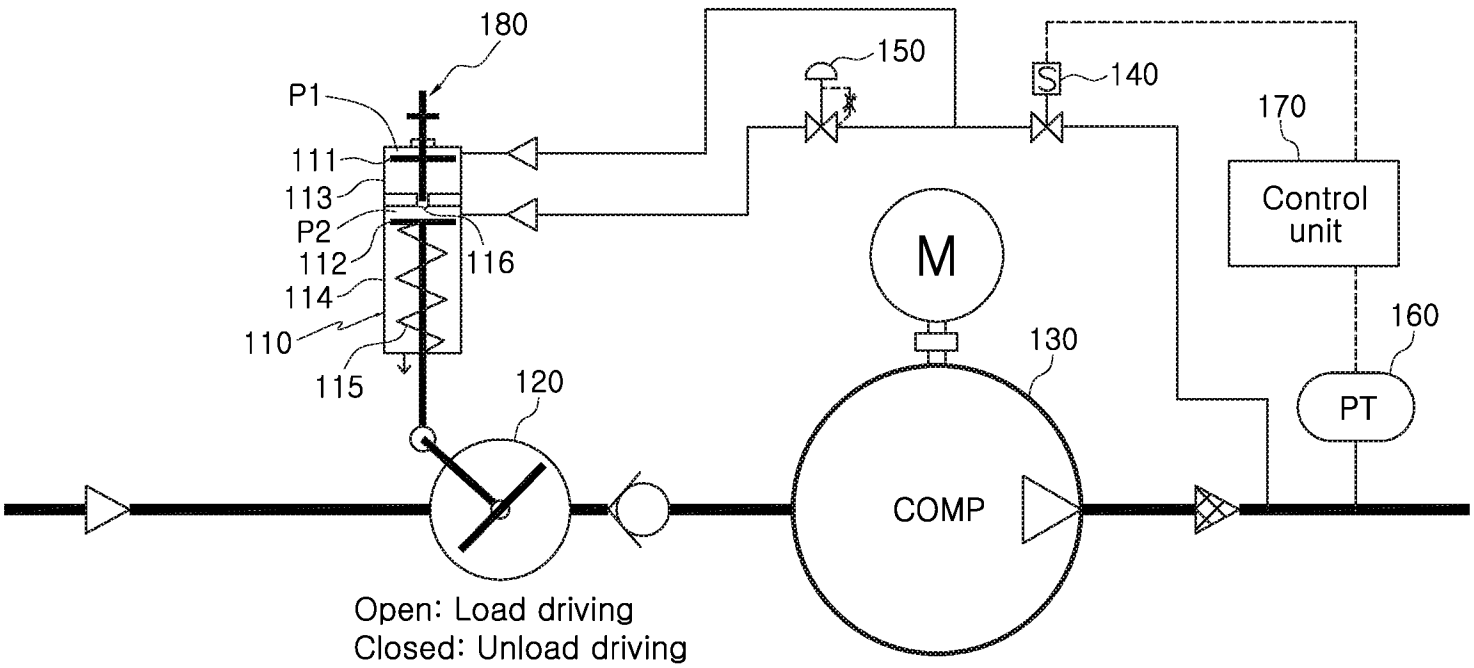
FIG. 6 is a schematic diagram showing the configuration of a compressor control system according to an embodiment of the present disclosure.

FIG. 6 is a schematic diagram showing the configuration of a compressor control system according to an embodiment of the present disclosure.

A cylinder 110 for control includes a first piston 111 and a second piston 112 therein, and a spring 115 is inserted and installed below the second piston 112.

The cylinder 110 for control includes a first piston chamber 113 in which the first piston 111 is placed and a second piston chamber 114 in which the second piston 112 is placed, the first piston chamber 113 and the second piston chamber 114 are in communication with each other by a through-hole 116, and the piston rod tip of the first piston 111 moves in or enters the second piston chamber 114 through the through-hole 116.

When a control valve 140 is open (ON), the first piston 111 advances downward by compressed fluid (oil or air) supplied to a pressure control area or an area (P1) above the first piston 111 through the control valve 140, and when the control valve 140 is closed (OFF), the first piston 111 retreats.

When the control valve 140 is open, the second piston 112 advances downward by compressed fluid (oil or air) supplied to a pressure control area or an area (P2) above the second piston 112 through a pressure control valve 150 and opens a compressor suction valve 120, and when the pressure of the fluid (oil or air) supplied to the area (P2) above the second piston 112 through the pressure control valve 150 reduces, the second piston 112 retreats upward by the restoring force of the spring 115 and closes the compressor suction valve 120, and when the control valve 140 is closed, the pressure of the area (P2) above the second piston 112 reduces and the second piston 112 retreats upward by the restoring force of the spring 115 and closes the compressor suction valve 120.

A stroke adjustment unit 180 adjusts the stroke of the first piston 111.

Figure 7:
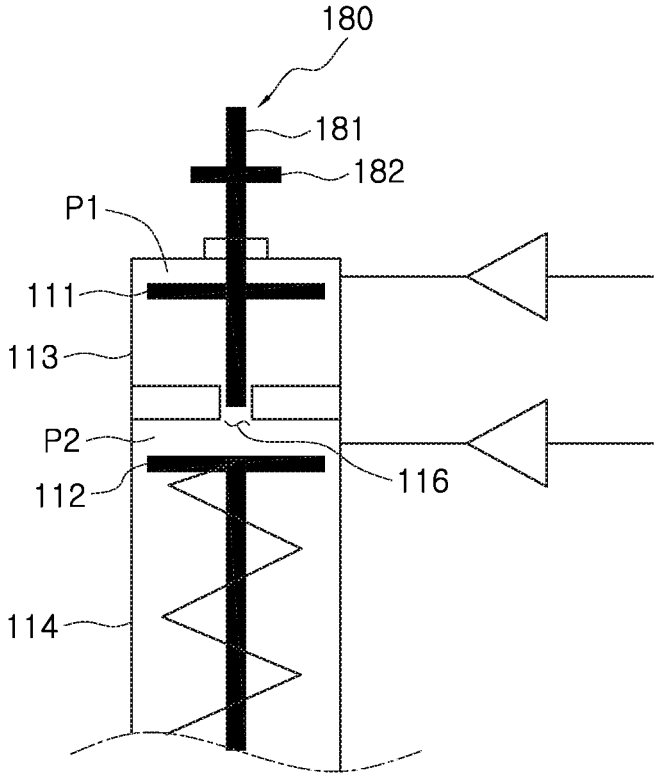
FIGS. 7 and 8 are exemplary diagrams showing a stroke adjustment unit applied to the present disclosure.

As shown in FIG. 7, the stroke adjustment unit 180 includes an extension rod 181 that is coaxial with the piston rod of the first piston 111 and extends in the opposite direction to the piston rod of the first piston 111 from the piston head of the first piston 111 and protrudes out of the cylinder 110 for control, and an adjusting piece 182 that is coupled to the extension rod 181 protruding out of the cylinder 110 for control and adjusts the stroke of the first piston 111 based on the coupling position.

The first piston 111 advances downward by the compressed fluid (oil or air) supplied to the area (P1) above the first piston 111 through the control valve 140, and when the first piston 111 moves down by the compressed fluid (oil or air) supplied to the area (P1) above the first piston 111, the piston rod of the first piston 111 enters the second piston chamber 114.

As described above, the first piston 111 advancing downward stops advancing by the adjusting piece 182 of the stroke adjustment unit 180, and the stroke of the first piston 111 may be adjusted based on the position to which the adjusting piece 182 is coupled.

That is, when the adjusting piece 182 is coupled to the upper part of the extension rod 181, the stroke of the first piston 111 is long. As above, if the stroke of the first piston 111 is long, when the first piston 111 advances downward by the compressed fluid (oil or air) supplied to the area (P1) above the first piston 111, the piston rod of the first piston 111 entering the second piston chamber 114 is long, and as a consequence, the stroke of the second piston 112 is short.

On the other hand, when the adjusting piece 182 is coupled to the lower part of the extension rod 181, the stroke of the first piston 111 is short. As above, if the stroke of the first piston 111 is short, when the first piston 11 advances downward by the compressed fluid (oil or air) supplied to the area (P1) above the first piston 111, the piston rod of the first piston 111 entering the second piston chamber 114 is short, and as a consequence, the stroke of the second piston 112 is long.

Figure 8:
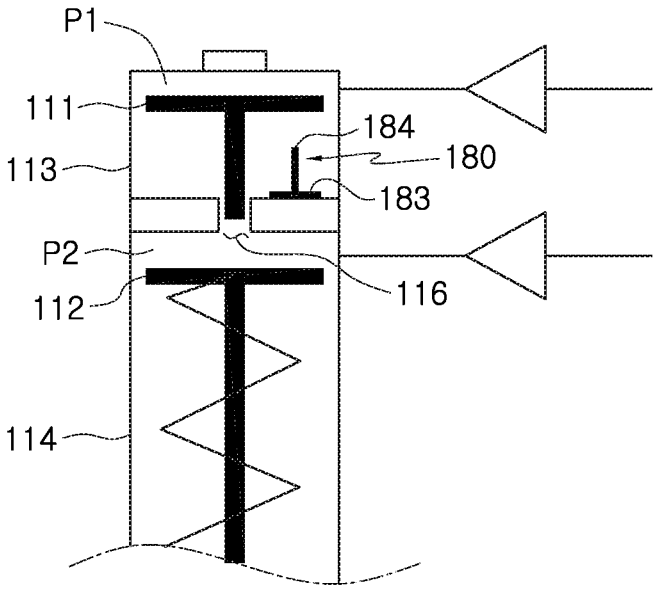

Meanwhile, as shown in FIG. 8, the stroke adjustment unit 180 may be formed in the first piston chamber 113.

The stroke adjustment unit 180 includes a fixing piece 183 fixed to the bottom of the first piston chamber 113, and an adjustment rod 184 that is coupled vertically to the fixing piece 183 and adjusts the stroke of the first piston 111 based on the length.

The first piston 111 advancing downward by the compressed fluid (oil or air) supplied to the area (P1) above the first piston 111 through the control valve 140 stops advancing by the adjustment rod 184 of the stroke adjustment unit 180, and the stroke of the first piston 111 may be adjusted based on the length of the adjustment rod 184.

That is, when the adjustment rod 184 is long, the stroke of the first piston 111 is short. As above, if the stroke of the first piston 111 is short, when the first piston 111 advances downward by the compressed fluid (oil or air) supplied to the area (P1) above the first piston 111, the piston rod of the first piston 111 entering the second piston chamber 114 is short, and as a consequence, the stroke of the second piston 112 is long.

Meanwhile, when the adjustment rod 184 is short, the stroke of the first piston 111 is long. As above, if the stroke of the first piston 111 is long, when the first piston 111 advances downward by the compressed fluid (oil or air) supplied to the area (P1) above the first piston 111, the piston rod of the first piston 111 entering the second piston chamber 114 is long, and as a consequence, the stroke of the second piston 112 is short.

Here, the stroke adjustment unit 180 may be only implemented with the adjustment rod 184.

Meanwhile, when the second piston 112 advances downward, the compressor suction valve 120 is opened, and when the second piston 112 retreats upward, the compressor suction valve 120 is closed as described previously, and a closing volume of the compressor suction valve 120 changes depending on how much the piston rod of the first piston 111 enters the second piston chamber 114 by the stroke adjustment unit 180.

That is, if the piston rod of the first piston 111 does not enter the second piston chamber 114 by the stroke adjustment unit 180, when the second piston 112 retreat upward, the second piston 112 can retreat to the end and the compressor suction valve 120 is fully closed.

On the contrary, when the piston rod of the first piston 111 enters the second piston chamber 114 by the stroke adjustment unit 180, and as a consequence, the second piston 112 retreats upward, the second piston 112 does not retreat to the end and is stopped by the piston rod of the first piston 111, and the compressor suction valve 120 is not fully closed.

Here, as the piston rod of the first piston 111 enters the second piston chamber 114 to a greater extent by the stroke adjustment unit 180 and the stroke of the second piston 112 is shorter, the closing volume of the compressor suction valve 120 is smaller.

As above, the closing volume of the compressor suction valve 120 may be adjusted by adjusting the stroke of the first piston 111 and the second piston 112 through the stroke adjustment unit 180, and adjustment of the closing volume of the compressor suction valve 120 may prevent the compressor suction valve 120 from being fully closed.

Meanwhile, the control valve 140 has a channel to supply the compressed fluid to the pressure control area of the first piston 111 or the area (P1) above the first piston 111 and the pressure control valve 150, and is opened/closed under the control of a control unit 170 so that the compressed fluid is supplied to the area (P1) above the first piston 111 or the supply is interrupted to advance the first piston 111 downward or retreat the first piston 111 upward, and the compressed fluid is supplied to the pressure control valve 150 or the supply is interrupted. Here, the pressure of the fluid supplied to the area (P1) above the first piston 111 and the pressure of the fluid supplied to the pressure control valve 150 by the control valve 140 are equal.

The control valve 140 may be implemented as a normal close (NC) type solenoid valve that is closed in normal condition in which power is not applied and is opened when power is applied.

The pressure control valve 150 is a mechanical proportional control valve, and has a channel to supply the compressed fluid to the pressure control area of the second piston 112 or the area (P2) above the second piston 112, and adjusts the fluid pressure of the area (P2) above the second piston 112 by a diaphragm type adjustment device installed therein.

The pressure control valve 150 may be implemented as a mechanical flow rate adjustment valve.

When the pressure control valve 150 operates in a proportional control driving mode, the pressure control valve 150 reduces the pressure of the fluid supplied through the control valve 140 and supplies it to the area (P2) above the second piston 112. Accordingly, the pressure of the fluid supplied to the area (P1) above the first piston 111 through the control valve 140 is larger than the pressure of the fluid supplied to the area (P2) above the second piston 112 through the pressure control valve 150.

A fluid condition transmission unit 160 detects the fluid condition (i.e., the pressure or flow rate of the fluid) at the rear end of a compressor 130, and converts the detected fluid condition value to an electrical signal and applies it to the control unit 170.

The control unit 170 controls the closing/opening of the control valve 140 based on the fluid condition (pressure or flow rate) value in the electrical signal form received from the fluid condition transmission unit 160, and when the pressure or flow rate of the compressor 130 is equal to or lower than the set working pressure, the control unit 170 maintains the control valve 140 under an open condition to operate the compressor 130 in a proportional control driving mode, and when the pressure or flow rate of the compressor 130 is higher than the set working pressure, the control units 170 closes the control valve 140 to operate the compressor 130 in an unload driving mode.

Figure 9:
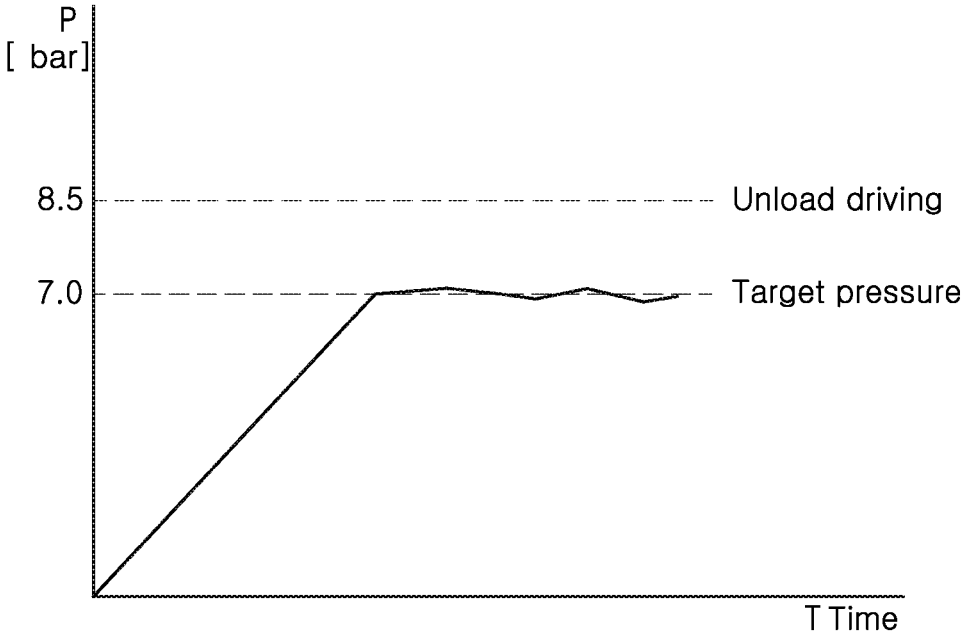
FIG. 9 is an exemplary diagram showing a pressure diagram appearing by reducing the width of control range in the operation of a compressor control system according to the present disclosure.

FIG. 9 is an exemplary diagram showing a pressure diagram in the operation of the compressor control system according to the present disclosure, in which the pressure of the compressor 130 is controlled using a plurality of pistons (a first piston and a second piston), and by reducing the adjustment range of the compressor suction valve 120, the pressure or flow rate of the compressor 130 is uniformly maintained compared to the conventional method.

Figure 10:
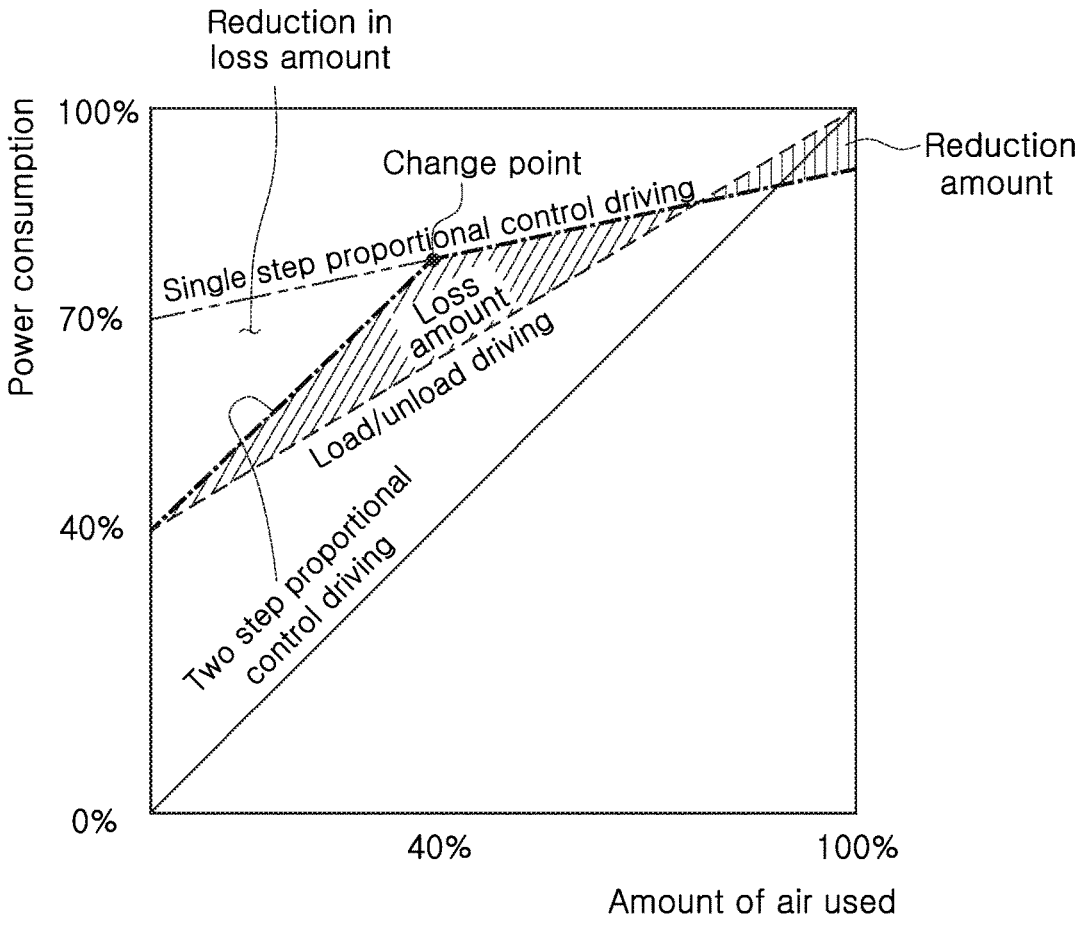
FIG. 10 is an exemplary diagram showing a power consumption diagram in the operation of a compressor control system according to the present disclosure.

FIG. 10 is an exemplary diagram showing a power consumption diagram in the operation of the compressor control system according to the present disclosure, in which when the first piston 111 advances and the second piston 112 performs proportional control in mechanical manner, if the fluid pressure of the area (P2) above the second piston 112 reduces, the second piston 112 retreats upward by the restoring force of the spring 115, and as a consequence, the compressor suction valve 120 starts to be closed. In this instance, the compressor suction valve 120 does not retreat to the end and is stopped by the piston rod of the first piston 111, and is not fully closed.

As above, when the compressor suction valve 120 is not fully closed, power consumption remarkably reduces with respect to a change point as shown in FIG. 10.

Here, the change point can change depending on the stroke of the second piston 112, and as the stroke of the second piston 112 is shorter, the closing volume of the compressor suction valve 120 is smaller and the change point moves right, and as the stroke of the second piston 112 is longer, the closing volume of the compressor suction valve 120 is larger and the change point moves left.

The stroke of the second piston 112 is adjusted by the stroke adjustment unit 180 as described previously.

Hereinafter, the operation of the compressor control system according to an embodiment of the present disclosure will be described.

First, when the compressor 130 starts load driving, the control unit 170 opens the control valve 140 and the pressure control valve 150 to supply compressed fluid (oil or air) to the area (P1) above the first piston 111, causing the first piston 111 to advance downward, and supply compressed fluid (oil or air) to the area (P2) above the second piston 112, causing the second piston 112 to advance downward.

When the second piston 112 advances by the fluid supplied to the area (P2) above the second piston 112, the compressor suction valve 120 is opened and compression starts.

In this instance, the control unit 170 drives the compressor 130 based on a pressure value (or flow rate value) received from the fluid condition transmission unit 160 detecting the pressure (or flow rate) at the rear end of the compressor 130 in real time, and maintains the open condition of the control valve 140 until the pressure value (or flow rate value) received from the fluid condition transmission unit 160 exceeds the set working pressure.

Meanwhile, the pressure control valve 150 performs proportional control in mechanical manner based on the pressure (or flow rate) at the rear end of the compressor 130, and when the pressure (or flow rate) at the rear end of the compressor 130 reaches a target pressure, the pressure control valve 150 reduces the pressure of the fluid supplied to the area (P2) above the second piston 112. Here, because the pressure control valve 150 reduces the pressure of the fluid (oil or air) supplied from the control valve 140 and supplies it to the area (P2) above the second piston 112, the pressure of the fluid (oil or air) supplied to the area (P2) above the second piston 112 is lower than the pressure of the fluid (oil or air) supplied to the area (P1) above the first piston 111.

As above, when the pressure of the fluid supplied to the area (P2) above the second piston 112 is reduced, the second piston 112 retreats by the restoring force of the spring 115, and the second piston 112 does not retreat to the end and is stopped by the piston rod of the first piston 111 advanced by the compressed fluid (oil or air) supplied to the area (P1) above the first piston 111, and the compressor suction valve 120 is not fully closed.

When the compressor suction valve 120 is not fully closed, an amount of energy loss may be reduced with respect to the change point as shown in FIG. 10. Additionally, noise and vibration occurring when the compressor suction valve 120 is fully closed may be reduced.

As above, when the pressure control valve 150 controls the pressure of the compressor 130 by performing proportional control in mechanical manner, the compressor suction valve 120 is not fully closed and the pressure of the compressor 130 keeps increasing.

Accordingly, when the pressure value (or flow rate value) received from the fluid condition transmission unit 160 exceeds the set working pressure, the control unit 170 closes both the control valve 140 and the pressure control valve 150.

As above, when the control valve 140 and the pressure control valve 150 are closed, the fluid supply to the area (P1) above the first piston 111 and the area (P2) above the second piston 112 is interrupted.

When the fluid supply to the area (P1) above the first piston 111 and the area (P2) above the second piston 112 is interrupted, the pressure of the area (P2) above the second piston 112 reduces and both the second piston 112 and the first piston 111 retreat upward by the restoring force of the spring 115, the compressor suction valve 120 starts to be fully closed, and the driving mode is shifted to an unload driving mode.

Figure 11:
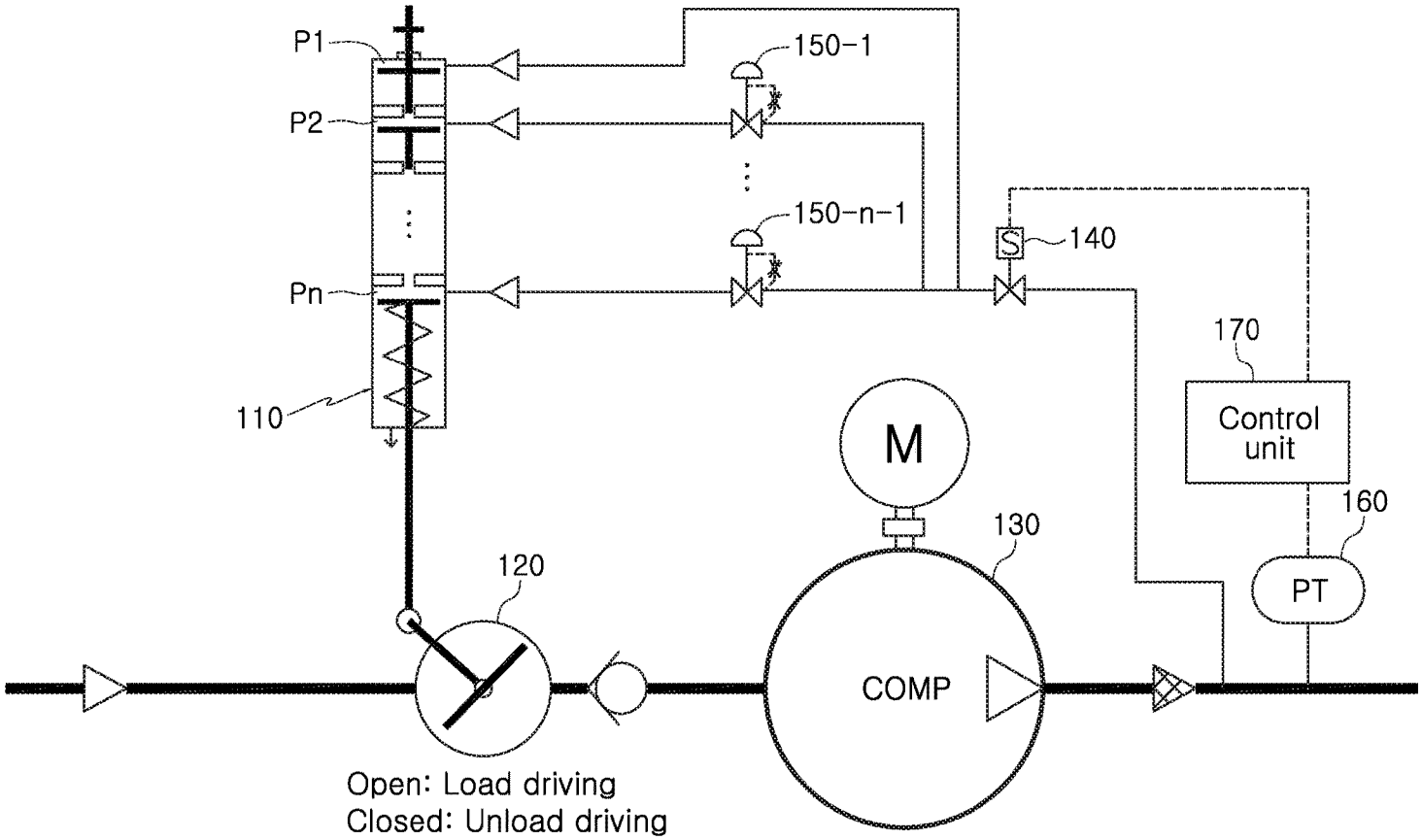
FIG. 11 is a schematic diagram showing the configuration of a compressor control system according to another embodiment of the present disclosure.

The compressor control system of the present disclosure is not limited to the above-described embodiments, and various modifications may be made to the embodiments without departing from the technical spirit of the present disclosure. For example, although the embodiment of the present disclosure describes two pistons 111, 112 included in the cylinder 110 for control, n (here, n is an integer greater than 2) pistons may be included in the cylinder 110 for control as shown in FIG. 11. As above, when n pistons are included in the cylinder 110 for control, n−1 pressure control valves 150 are provided to supply fluid to operate each piston to areas above second to $n^{th}$ pistons, and the control valve 140 supplies fluid to operate a first piston at the uppermost to an area above the first piston and supplies fluid to n−1 pressure control valves 150. Accordingly, the pressure (or flow rate) of the compressor may be accurately controlled and uniformly maintained by controlling the pressure of the compressor using n pistons.

| Detailed Description of Main Elements | |
|---|---|
| 110: Cylinder for control | 111: First piston |
| 112: Second piston | 113: First piston chamber |
| 114: Second piston chamber | 115: Spring |
| 116: Through-hole | 120: Compressor suction valve |
| 130: Compressor | 140: Control valve |

-continued

| Detailed Description of Main Elements | |
|---|---|
| 150: Pressure control valve | 160: Fluid condition transmission unit |
| 170: Control unit | 180: Stroke adjustment unit |

What is claimed is:

1. A compressor control system, comprising:

a cylinder including a first piston and a second piston therein;

a pressure control valve which supplies fluid to operate the second piston to an area above the second piston;

a control valve which supplies fluid to operate the first piston to an area above the first piston, and supplies fluid to the pressure control valve;

a fluid condition transmission unit which detects fluid condition (pressure or flow rate) at a rear end of a compressor, and converts the detected fluid condition value to an electrical signal and outputs it; and a control unit which controls closing/opening of the control valve based on the fluid condition value received from the fluid condition transmission unit.

2. The compressor control system according to claim 1, wherein the cylinder includes:

a first piston chamber in which the first piston is placed; and a second piston chamber in which the second piston is placed, and the first piston chamber and the second piston chamber are in communication with each other through a through-hole, and a piston rod tip of the first piston enters the second piston chamber through the through-hole.

3. The compressor control system according to claim 1, wherein a pressure of the fluid supplied to the area above the first piston is larger than a pressure of the fluid supplied to the area above the second piston.

4. The compressor control system according to claim 1, further comprising:

a stroke adjustment unit to adjust stroke of the first piston.

5. The compressor control system according to claim 4, wherein the stroke adjustment unit includes:

an extension rod which is coaxial with a piston rod of the first piston, and extends in opposite direction to the piston rod of the first piston from a piston head of the first piston; and an adjusting piece which is coupled to the extension rod protruding out of the cylinder to adjust the stroke of the first piston.

6. The compressor control system according to claim 4, wherein the stroke adjustment unit includes:

a fixing piece fixed to bottom of the first piston chamber; and an adjustment rod coupled vertically to the fixing piece to adjust the stroke of the first piston.

7. The compressor control system according to claim 1, wherein when n pistons are included in the cylinder, n−1 pressure control valves are provided to supply fluid to each piston to areas above second to $n^{th}$ pistons, and the control valve supplies fluid to operate a first piston to an area above the first piston and supplies fluid to the n−1 pressure control valves.

* * * * *